US010393469B2

(12) United States Patent
Fibiger

(10) Patent No.: US 10,393,469 B2
(45) Date of Patent: Aug. 27, 2019

(54) ARCHERY BOW

(71) Applicant: FIBIGER COMPANY, San Bernardino, CA (US)

(72) Inventor: Peter K. Fibiger, San Bernardino, CA (US)

(73) Assignee: FIBIGER COMPANY, San Bernardino, CA (US)

( * ) Notice: Subject to any disclaimer, the term of this patent is extended or adjusted under 35 U.S.C. 154(b) by 0 days.

(21) Appl. No.: 15/653,512

(22) Filed: Jul. 18, 2017

(65) Prior Publication Data

US 2019/0025002 A1 Jan. 24, 2019

(51) Int. Cl.

| | |
|---|---|
| ***F41B 5/22*** | (2006.01) |
| ***F41B 5/10*** | (2006.01) |
| ***F41B 5/12*** | (2006.01) |
| ***F41B 5/14*** | (2006.01) |

(52) U.S. Cl.

CPC ..... *F41B 5/10* (2013.01); *F41B 5/105* (2013.01); *F41B 5/12* (2013.01); *F41B 5/143* (2013.01)

(58) Field of Classification Search

CPC .... F41B 5/00; F41B 5/12; F41B 5/123; F41B 5/10; F41B 3/02; F41B 5/143

See application file for complete search history.

(56) References Cited

U.S. PATENT DOCUMENTS

| | | | | |
|---|---|---|---|---|
| 1,781,530 A | | 11/1930 | Smith | |
| 2,645,217 A | | 7/1950 | Fisher | |
| 2,715,895 A | | 6/1952 | Loveless | |
| 2,954,764 A | * | 10/1960 | Stinson | F41B 5/066 124/25.7 |
| 3,018,770 A | | 1/1962 | Saunders | |
| 3,455,288 A | | 7/1969 | Knerr | |
| 3,517,657 A | | 6/1970 | Alban | |
| 3,614,947 A | | 10/1971 | Feldman | |
| 4,515,301 A | | 5/1985 | A'Costa | |
| 4,844,390 A | | 7/1989 | Duke | |
| 4,873,963 A | | 10/1989 | Lemmen | |
| 4,957,093 A | | 9/1990 | Hamlett | |
| D314,287 S | | 2/1991 | Albright, Sr. | |
| 4,996,968 A | | 3/1991 | Hollingsworth | |
| 5,060,409 A | | 10/1991 | Caustic | |
| 5,111,983 A | | 5/1992 | Simmons et al. | |
| 5,194,678 A | | 3/1993 | Kramer | |
| 5,351,867 A | | 10/1994 | Vest | |
| 5,632,262 A | | 5/1997 | Hanson | |
| 5,641,147 A | | 6/1997 | Pena | |
| 5,903,995 A | | 5/1999 | Brubach | |

(Continued)

FOREIGN PATENT DOCUMENTS

| | | |
|---|---|---|
| WO | 2013133853 | 9/2013 |

*Primary Examiner* — John A Ricci
(74) *Attorney, Agent, or Firm* — Karish & Bjorgum, PC

(57) ABSTRACT

An archery bow having a vertically positioned handle and an elongated center block affixed to the handle in a perpendicular configuration is provided. A pair of limbs are affixed to the center block and having a pair of cams (or pulleys) are rotatably attached to the limbs. A bowstring is formed between the first and second cams. The handle, center block, limbs, and bowstring are configured to discharge an arrow from a plane substantially perpendicular to a shooter. An arm stabilizer may also be provided to engage the forearm of the shooter and provide stabilization when the archery bow is aimed or fired.

9 Claims, 5 Drawing Sheets

(56) References Cited

U.S. PATENT DOCUMENTS

| | | | | |
|---|---|---|---|---|
| 5,988,466 | A | 11/1999 | Brown | |
| 6,843,015 | B2 | 1/2005 | Sharp | |
| 7,059,314 | B1 | 6/2006 | Teague | |
| 8,689,775 | B2 | 4/2014 | Eee | |
| 9,170,065 | B2 | 10/2015 | Canterbury | |
| 9,310,171 | B2 | 4/2016 | Cummings | |
| 9,341,448 | B2 | 5/2016 | Cummings | |
| 9,482,501 | B2 | 11/2016 | Cummings | |
| 2010/0313864 | A1* | 12/2010 | Gardner | F41A 23/06 124/25.6 |
| 2014/0165981 | A1 | 6/2014 | Lien | |

* cited by examiner

ARCHERY BOW

BACKGROUND

All bows consist of a string attached to flexible limbs that store mechanical energy imparted by the user drawing the string. Bows may be generally split into two categories: those drawn by pulling the string directly and those that use a mechanism to mechanically draw the string.

Mechanically drawn bows, such as a crossbow, typically have a stock or other mounting and the limbs and bow string of the crossbow are mounted perpendicular to the stock. Compared to direct drawn bows, mechanically drawn bows typically have shorter draw length and a heavier draw weight is required to achieve the same energy transfer to the arrow. Mechanically drawn bows generally also have devices to hold the tension when the bow is fully drawn and are not limited by the strength of a single archer.

Direct drawn bows generally consist of an elongated piece of plastic or wood having a central non-dominant hand grip with spring-like limbs where a bow string is stretched from each attached outer ends of the limbs. Examples of direct drawn bows include a longbow, recurve bow or compound bow. Direct drawn bows are typically categorized based upon differences in limb construction or bow shape of the limbs when unstrung. In direct drawn bows, arrows are released from either the left or right side of the bow, depending on cultural preference and/or right or left handedness. This affects the hand grip and position of the bow.

Compound bow designs use cams or elliptical wheels on the ends of the limbs to reduce muscular stress of the archer and allow the archer more time to aim, while increasing the force of a discharged arrow by uning the effect of a cam or a wheel. As a result, the compound bow has a very fast speed of the discharged arrow and is widely used for hunting. A prior art compound bow 10 is shown in FIG. 1. The prior art compound bow shown in FIG. 1 has an upper blade 12 on an upper portion of a handle 18 and a lower blade 14 positioned on the lower portion of the handle 18. A cam unit 16*a*, 16*b* is rotatably installed between the upper and lower blades 12, 14 and the bow string 20 is positioned therebetween. As shown in FIG. 1, the compound bow design is substantially positioned in a single plane, with respect to the handle 18, blades (12, 14), cams (16*a*, 16*b*) and bow string 20, and is either right or left handed. When the bow is drawn, the bow is substantially parallel to the users body and requires a substantial amount of draw strength, even with the compound bow design.

Crossbows are typically mechanically drawn and incorporates a rifle-like stock with spring arms and a trigger mechanism for the hold and release of the bow string to propel an arrow. A typical crossbow has a trigger mechanism that mimics the firing of a firearm (pistols, rifles, etc.). Although crossbows have been used for hunting for many years, most crossbows can only be used for hunting during very specific hunting seasons where firearms can be used because the crossbow has attributes relating to a firearm. Crossbows cannot be used during seasons where archery-only is used in many states and provinces in the United States and Canada.

Crossbows have proven to be popular hunting weapons, despite the crossbows general bulkiness and weight. However, hunting season and archery season in the United States and Canada vary, depending on state and province laws. The use of crossbows, specifically, is even more restricted during the hunting and archery seasons and the use of mechanically fired crossbows is prohibited in archery-only seasons in most jurisdictions. This makes it more difficult for crossbow hunters to use their hunting weapon of choice whenever they want to hunt.

Accordingly, there are a number of known archery bows for the shooting of classic and conventional arrows. These bows range from being fairly complex to rather simple. However, in order for an archery bow to be of maximum use to the hunter, it needs to be able to shoot arrows precisely, forcefully, and safely. Further, though known improvements in archery bows have improved the accuracy and propelled distance of archery bows, restrictions on the use of archery weapons during various hunting seasons limit the choice of that archery weapon.

Therefore, there is a need for an archery bow which can be used during archery-only season that retains one or more advantages of a crossbow. In addition, there is a need for an improved archery bow which has the ease of use, durability, and lightweightness of the traditional archery bow, but with improved accuracy of the launch of arrows, and adaptability for use by both right- and left-handed hunters.

SUMMARY

According to the present invention, an archery bow is provided that, under most current regulations, can be used during any hunting season. The archery bow of the present invention is smaller and more compact than either a crossbow or a compound bow, but provides a crossbow's high propulsion without a trigger mechanism as in a direct drawn bow. Further, the archery bow according to the present invention is more lightweight and affordable than its crossbow counterparts. In some embodiments, the archery bow is stabilized with an arm stabilizer (or arm brace) to provide the bow with additional stability and accuracy, and/or removably attached to a "steady stick" also for more stability and accuracy. In other embodiments, the steady stick, when detached, can double as a walking stick.

According to the present invention, an archery bow having a center block comprising a vertical handle, an elongated center block affixed to the handle in a perpendicular configuration, and an arm stabilizer is provided. First and second limbs are affixed to the center block and first and second pulleys (also referred to herein as cams) are rotatably combined with the respective first and second limbs so as to rotate around a rotating axis of each pulley. A bowstring is positioned between the first and second pulleys. The first and second limbs and the bowstring are configured to discharge an arrow from a plane substantially perpendicular to a shooter. In some embodiments, an arm stabilizer is also provided which extends rearwardly from the center block to engage the forearm of the shooter and provide stabilization when the archery bow is aimed or fired.

DESCRIPTION OF DRAWINGS

These and other features, aspects and advantages of the present invention will become better understood from the following description, appended claims, and accompanying figures, where like numbers reference like elements. The figures described should not be interpreted as indicating relative proportions of the components therein, where:

DESCRIPTION

There are a number of archery bows known in the art. However, these known devices or hunting tools have many drawbacks, such as the lack of ease of use, the lack of accuracy of the launch of arrows, the lack of durability and lightweightness, the restrictions on use during various hunting seasons, as well as the inability to be used by both right- and left-handed hunters.

According to the present invention, an archery bow is provided that incorporates ease of use, is highly accurate, and can be used by both right- and left-handed hunters. As the archery bow, according to the present invention, does not incorporate a firing mechanism and is therefore not generally restricted from use during archery season. Further, the archery bow, according to the present invention, is designed for durability and lightweightness, while still retaining the function of a powerful draw strength with reduced force required to hold the string at full draw. This allows the user more time to aim with less muscular stress and bow use is not limited to the strength of an individual user.

The archery bow according to the present invention projects an arrow from a horizontal bow position without a trigger mechanism, thereby making the archery bow usable during archery-only hunting season, while still incorporating many of the advantages of a crossbow.

In certain embodiments, a steady stick is incorporated, which allows for a resting stand that is attachable (and detachable) to the central component. This further increases the ease of use and accuracy of the archery bow according to the present invention.

Figure 1:
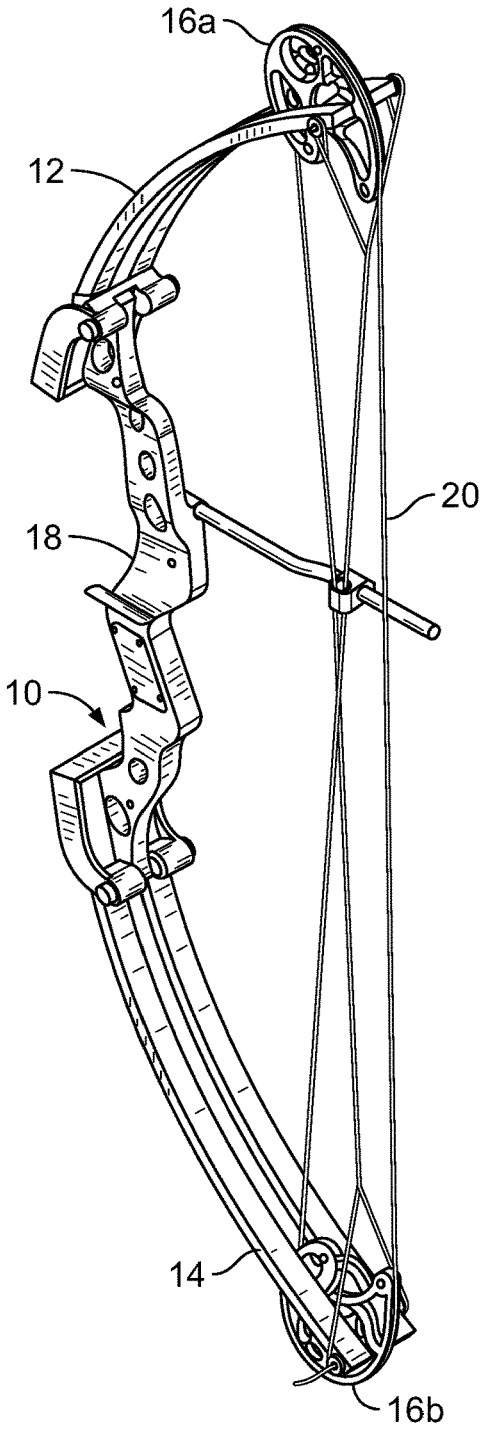
FIG. 1 (Prior Art)
FIG. 1 is a perspective view illustrating a conventional compound bow.
Figure 2:
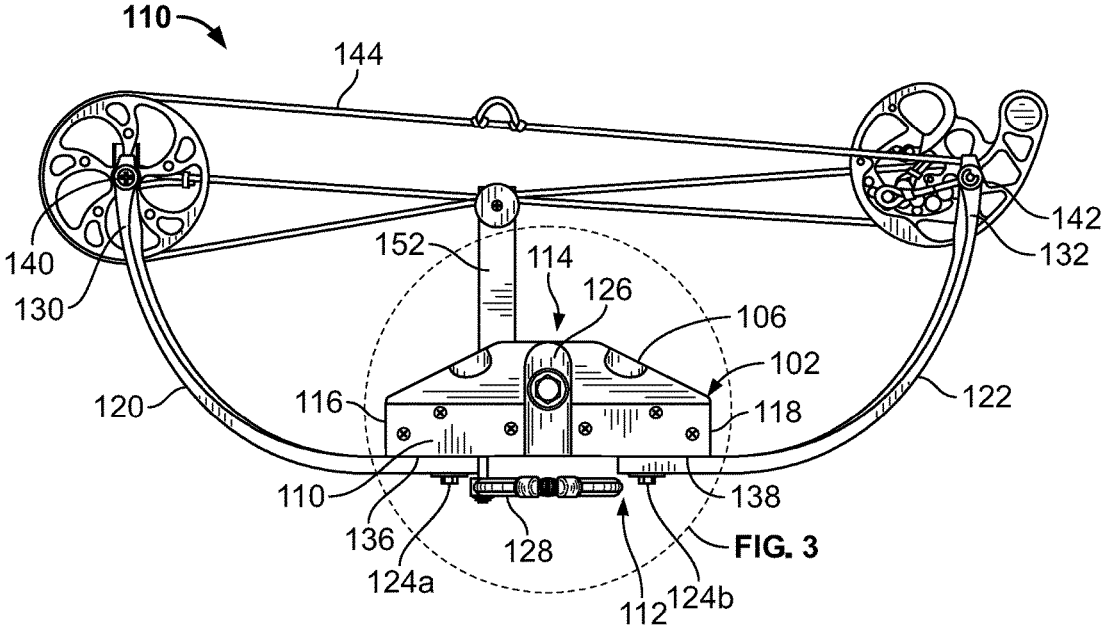
FIG. 2 is a top plan view showing an archery bow according to a first embodiment of this invention.
Figure 3:
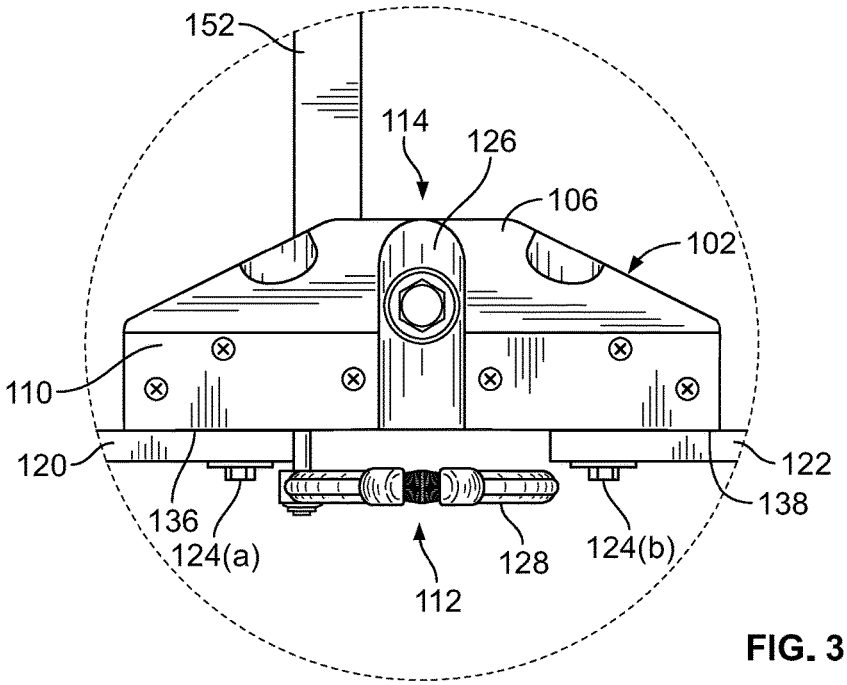
FIG. 3 is an expanded top plan view of the center block shown in FIG. 2.
Figure 4:
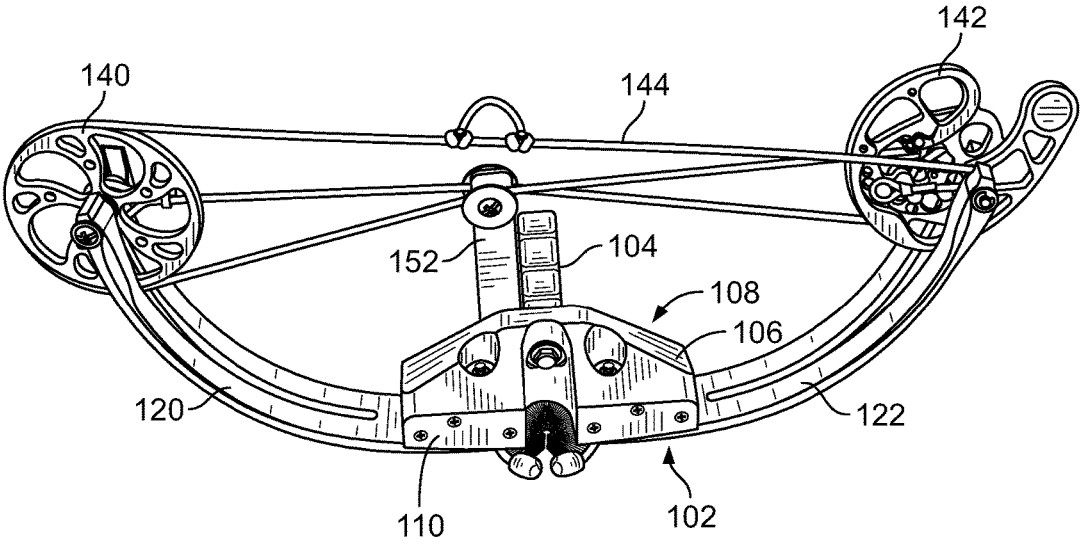
FIG. 4 is a bottom, front perspective view of the archery bow shown in FIG. 2.
Figure 5:
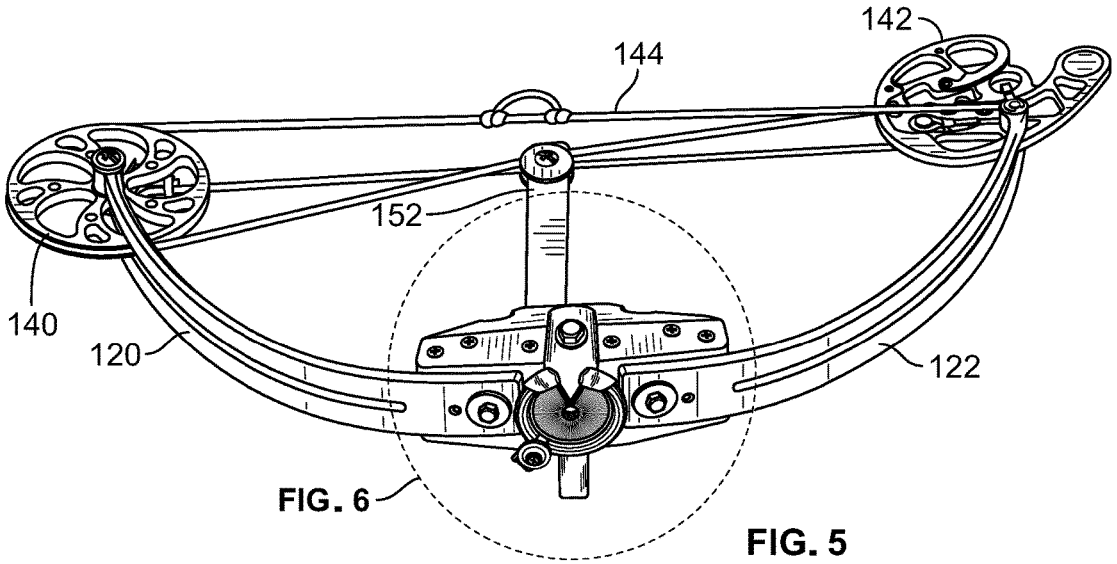
FIG. 5 is a top, front perspective view showing the center stock, limbs, and handle of the archery bow shown in FIG. 2.
Figure 6:
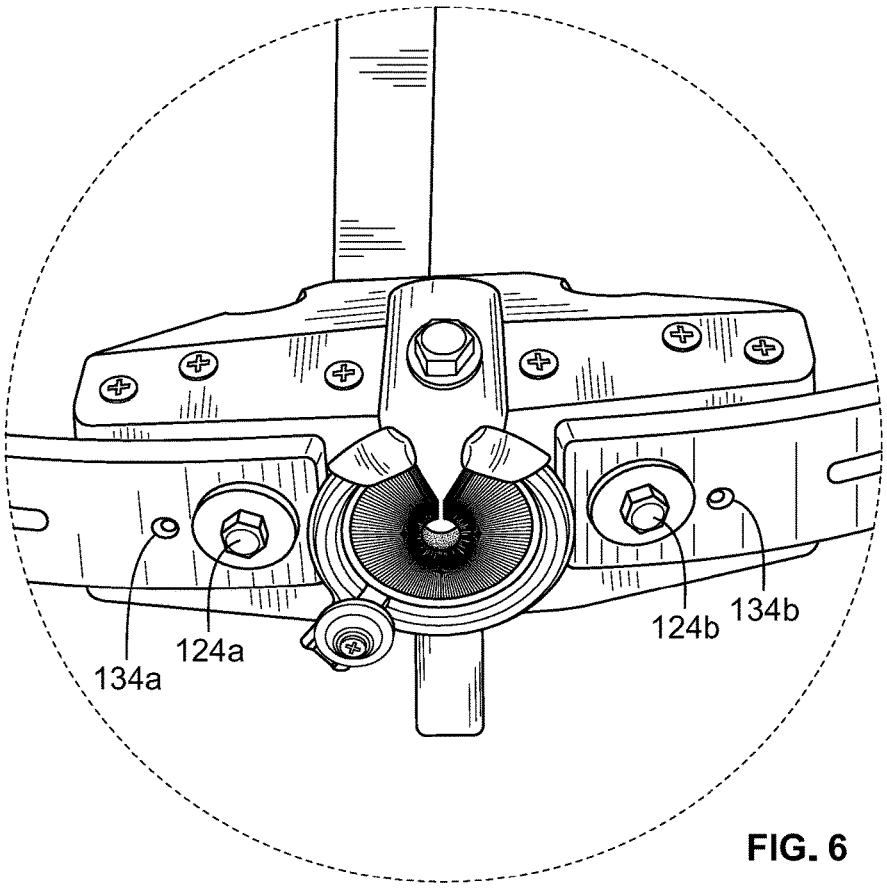
FIG. 6 is an expanded top, front perspective view of the center block shown in FIG. 5.
Figure 7:
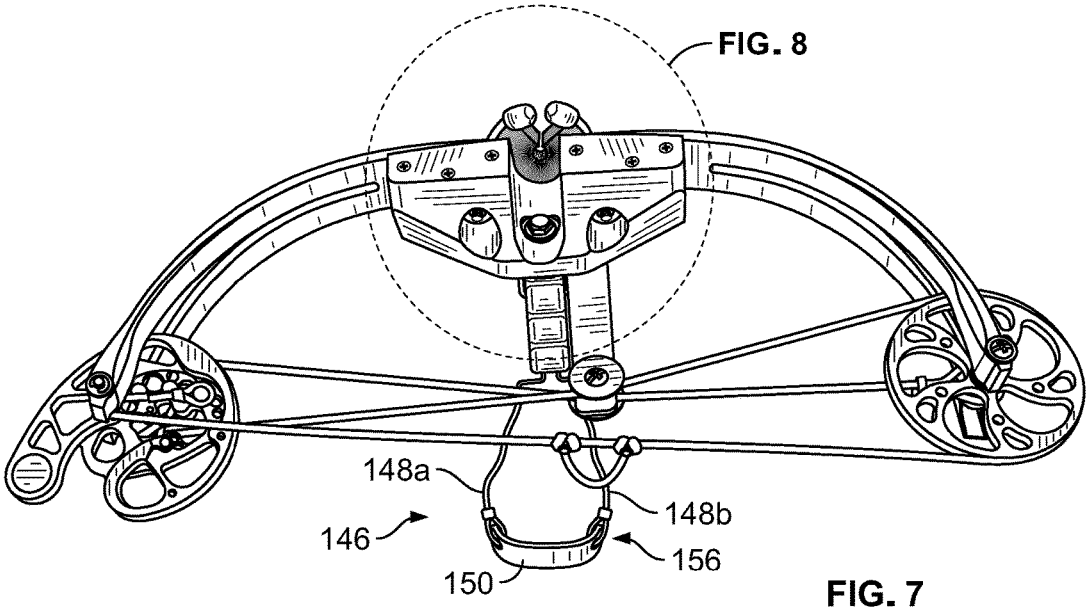
FIG. 7 is a top, rear perspective view showing the center block, limbs, handle, cams and bow string of the archery bow shown in FIG. 2.

According to the present invention, a horizontal archery bow will be described with reference to the accompanying drawings, FIGS. 2-8. Referring now to FIG. 2, a top plan view showing the horizontally configured archery bow 100 according to a first embodiment of the present invention is shown. Referring to FIG. 3, an expanded top plan view of the center block shown in FIG. 2 is shown. Referring to FIG. 4, a bottom, front perspective view of the archery bow showing in FIG. 2 is shown, which illustrates the configuration of the bow limbs and bow strings relative to the center block. Referring to FIG. 5 a top, front perspective view showing the center block, limbs, and handle of the archery bow shown in FIG. 2 is shown. Referring to FIG. 6, an expanded front perspective view of the center block shown in FIG. 5 is shown. FIG. 7 is a top, rear perspective view showing the center block, limbs, handle, cams (also referred to herein as a pulley or pulleys) and bowstring of the archery bow shown in FIG. 2, and FIG. 8 is an expanded top, rear view of the center block, also showing an embodiment having a stabilizer arm.

As illustrated in FIGS. 2-8, the archery bow 100 according to a first embodiment of the invention includes a center block 102 having a bow handle 104 and a center block 106. The center block 106 is affixed perpendicular to the bow handle 104, such that the handle 104 and the center block 106 forms a T-shape with the handle extending downward from a bottom side 108 of the center block 106. The handle 104 and center block 106 can be of unitary construction or can be assembled from two or more pieces with appropriate attachment hardware as will be understood by those of skill in the art.

Figure 8:
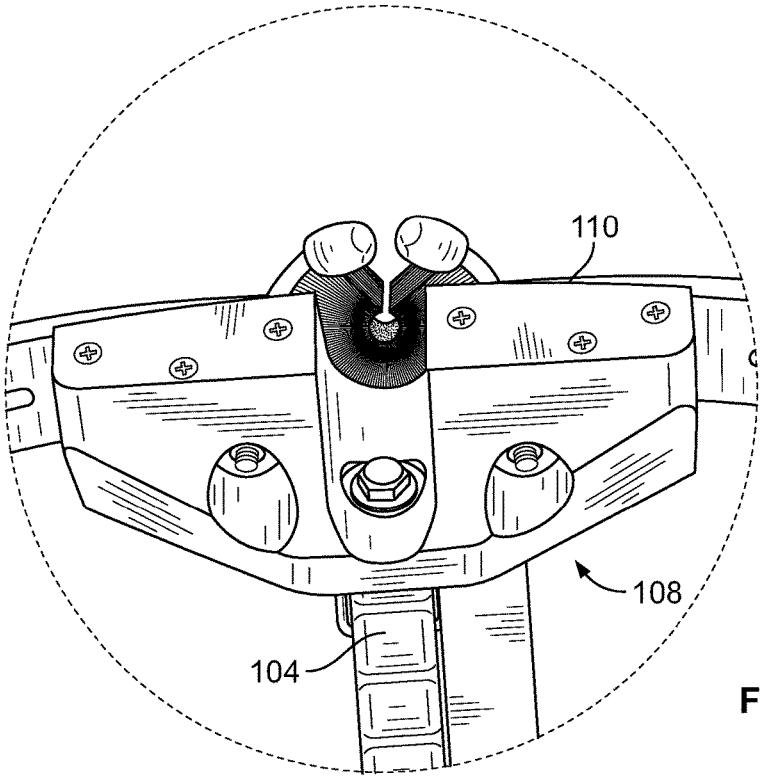
FIG. 8 is an expanded top, rear perspective view of the center block.

The center block 106 is shown in more detail in FIGS. 3, 6, and 8. The center block 106 has a bottom side 108, top side 110, has a front side 112, back side 114, first end portion 116 and second end portion 118. A first limb 120 is attached to the center block 106 at the first end portion 116 of the center block 106 at a first limb base 136. A second limb 122 is attached to the center block 106 at the second end portion 118 of the center block 106 at a second limb base 138. The first and second limbs 120 and 122 can be attached to the front side 112 of the center block 106, as shown in FIGS. 3 and 6, or can be otherwise attached to the center block 106, such as flush with the center block 106, by forming a recess in the center block 106 (not shown), or otherwise attached to the center block 106, such as positioned within the center block 106, through an incision in the center block 106 (not shown), or to the back side 114 of the center block 106 (not shown), as will be understood by those of skill in the art. The first and second limbs 120, 122, may be removably attached to the center block 106 with a limb attachment fastener 124*a*, 124*b*, such as a screw, bolt, pin or other attachment means. In an alternate embodiment, the first and second limbs 120, 122 are of unitary construction with the center block 106 and the limb attachment fastener 124*a*, 124*b* and limb bases 136, 138 are not present in the invention.

The center block 106 has a central bore 126 extending through the center block 106 where arrows shot with the archery bow 106 are positioned prior to shooting. An arrow guide 128 is positioned on the front side 112 of the center block 106 and in front of the central bore 126. The arrow guide 128 is preferably attached centrally to the center bore 126 of the center block 106 to have the arrow shaft pass through in a direction orthogonal to the direction of travel of an arrow launched from the archery bow 100. The arrow guide 128 provides the means of supporting the forward end of the arrow prior to launch. Examples of arrow guides can be found in U.S. Pat. Nos. 2,645,217; 3,455,288; and 3,018,770. Preferably, the arrow guide 128 has a combination of different arrow-holding designs in which the hunter can rest the arrow into the ready-to-fire position until just prior to being fired.

As shown in FIG. 4, the handle 104 preferably has a grip portion. The grip portion preferably extends a portion of the handle 104, which is long enough to accommodate a hand grip of suitable size. Alternately, the grip portion of the handle extends the length of the handle 104, downwardly from the bottom side 108 of the center block 106. The grip portion may be integrally formed with the handle 104, or preferably is a separate piece which is secured to a front portion of the handle 104, in a known manner.

The center block 106 is preferably composed of a lightweight but durable material such as a heavyweight polymeric material, aluminum, or other metal and composite materials suitable for construction of an archery bow, such as aluminum-magnesium alloy, and/or aluminum-magnesium-carbon composite material.

The first and second limbs 120, 122 are positioned at the end portions of the center block 106 and extend outwardly from the center block to first and second limb end portions 130, 132. The first and second limbs 120, 122 may be removably connected to the center block 106 and have one or more attachment bores 134*a*, 134*b* positioned on the limbs 120, 122 for attachment to the center block. Preferably, the first limb 120 is attached to the end portion 116 of the center block 106 at two or more attachment points and the second limb 122 is attached to the second end portion 118 at two or more attachment points. The limbs 120 and 122 are preferably secured to their respective first and second limb bases 136, 138 by a limb attachment fastener 124*a*, 124*b*, for example, a flat head socket cap screw, or other attachment means such as bolts, rivets and/or cam locks. Multiple or extended attachment points between the limbs 120, 122 and the limb bases 136, 138 provide a more fixed base and reduce noise and vibration. The limbs 120, 122 can have limb savers mounted on their surface to reduce vibrations (not shown). The limbs 120, 122 are preferably made of a durable but substantially flexible material, such as wood or a polymeric composite material, such as fiberglass or carbon composite material.

In certain embodiments, the limbs 120, 122 may be recessed either on the front or back sides, or both to facilitate a flush attachment arrangement with the center block 106. In other embodiments, the limbs and center block are of unitary construction and the attachment bores 134*a*, 134*b* are not present in the invention.

A first cam 140 is attached to the first limb 120 and a second cam 142 is attached to the second limb 122. The cams 140 and 142 are referred to herein as a cam or cams, and also a pulley or pulleys, the terms are understood to be used herein interchangeably. A bowstring 144 is strung around the cams 140, 142 to create the "block and tackle effect" of the typical compound bow. However, It will be noted that unlike the typical prior art compound bow, the cams are mounted perpendicular to the handle 104, and the bowstring 144 is also perpendicular to the handle 104. Sound and vibration dampening items such as "cat whiskers," "string leeches," and "beaver balls," can be optionally applied to the bowstring 144 to further reduce sound and vibration during firing.

Referring again to FIGS. 3, 6, and 8, the center block 106 has a front side 112, back side 114, top side 110 and bottom side 108 and end portions 116, 118. The space between the end of the first and second end portions 116, 118 of the center block 106 is referred to herein as the center block length. Preferably, the center block length is from between about 4 and 9 inches. The space between the front side 112 and back side of the center block 106 is referred to herein as the center block width. The center block width is preferably between about 1 inch to about 5 inches. The space between the top side 110 and the bottom side 108 is referred to herein as the center block height. Preferably, the center block height is between about 2 inches and about 7 inches. More preferably, the center block width is about 7 inches, the center block width is about 2 inches and the center block height is about 2 inches.

The limbs 120, 122 extend outwardly from the center block 106 to first and second limb end portions 130, 132, to which are affixed first and second cams 140, 142. As the handle 104, is affixed to the bottom side 108 of the center block 106, and configured such that the length of the handle 104 is perpendicular to the length of the center block 106, the length of the bow 100, cam 140 to cam 142 can be configured to be substantially shorter than that of prior art full sized bows.

The space between the first and second limbs 120, 122 is referred to herein as the limb distance. The limb distance is preferably between about 1 inch to about 5 inches. However, the limb distance can vary depending on the length and size of the limbs and the size of the arrows (e.g., feathers). In addition, the size of the arrow guide 128 is a factor when sizing the distance between the limbs.

Referring again to FIGS. 2, 4, 5 and 7, the bow 100 has a bow length, referred to herein as the distance from cam 140 to cam 142. The bow length can be from about 12 inches to about 36 inches. Preferably, the bow length from cam 140 to cam 142 is from about 18 inches to about 20 inches. However, in other embodiments, such as those designed for smaller users or children the preferred bow length is as short as 12 inches, and in other embodiments, for large users or specific applications, the bow length is as large as 36 inches.

Referring again to FIGS. 2, 3, 5, and 6, the bow 100 has a bow width, referred to herein as the distance from the front side 112 of the center block 106 and the bowstring 144. The bow width can be from about 3 inches to about 20 inches. Preferably, the bow width is from about 8 inches to about 12 inches. The bow width is dependent on (1) the angle of the limbs and/or the amount of bend in the limbs at rest; (2) the length of the arms of the user; and (3) the size of the cams 140, 142.

The bow 100 optionally may have a cable guide 152 for the bowstring 144. The cable guide 152 helps the bow 100 draw more smoothly and moves the bowstring 144 away from an arrow to be fired. The cable guide 152 is positioned on the center block 102 and extending from the center block 102 to engage the bowstring 144.

In certain embodiments, an arm stabilizer 146 is affixed to the center block 102. The arm stabilizer 146 has a pair of brace bars 148*a*, 148*b*, which extend rearwardly from the center block 102 and are joined at a tail portion 156, having an arch bend, and are joined with a strap 150. In some embodiments, the arm stabilizer is attached to an lower portion of the handle 104, such as shown in FIG. 7. In other embodiments, the arm stabilizer is attached to an upper portion of the handle 104, on the bottom side 108 of the center block. The brace bars 148*a*, 148*b* extend rearwardly from the center block 102 and are used to support the curved supporting strap 150 that fits against the forearm of either the left or right forearm of the user when the device is fired. Various other constructions of the arm stabilizer 146 are possible within the scope of this invention, provided that they are operable to engage the strap 150 when the bow 100 is in the ready-to-fire position. The strap 150 may be formed of leather, or another sufficiently strong and pliable material to conform to the shape of the users forearm, such as fabric or woven plastic. Preferably, the arm stabilizer 146 extends from the center block 102, approximately 10-14 inches, depending on the forearm length of the user. For example, in one embodiment sized for an adult male, the arm stabilizer 146 extends approximately 12 inches in length, including the strap 150, such that the strap rests on the forearm and sufficiently engages the forearm. Preferably, the strap 150 has a width of about 3-5 inches, more preferably, 4 inches and a curved radius for resting on the forearm. The downward oblique tension of the arm stabilizer 146 provides a counteracting force to the upward movement of the bow 100 upon firing. The arm stabilizer 146 reduces or eliminates the undesirable shaking or movement of the bow when sighting on target (e.g., prey or a stationary target) such that the arrow does not significantly move from the aimed position, increasing accuracy. In preferred embodiments, the bow 100 and arm stabilizer 146 are configured to be used interchangeably with a right- or left-handed shooter.

In other embodiments, a removably attached steady stick is provided. In this embodiment, the center block 102 may be modified to removably attach the steady stick. The steady stick lessens fatigue for a hunter using the bow 100 such that the user does not have to hold the bow still for a long period of time, especially while trying to focus and aim on an animal that is prone to move.

The steady stick may be a monopod, bipods or tripods. Preferably, the steady stick is a monopod which can be easily removed when the hunter needs to be on-the-move, or remain attached and used as a walking stick when traveling long distances, especially through brush. Due to its monopod design, the steady stick can also swivel or turn when stable on the ground. Examples of supports suitable a steady stick according to the present invention are described in U.S. Pat. Nos. 5,194,678; 5,988,466; 5,641,147; 6,843,015; and 5,903,995, although the steady stick design is not limited to these disclosures, as will be understood by those of skill in the art.

The archery bow 100, as described herein, distinct in appearance and operation. The archery bow provides an arrow-launching hunting weapon that employs multiple mechanical advantages in conjunction with a unique compound bow design, empowering a wider range of performance characteristics. In addition, the archery bow 100 provides a compound bow design with sling-shot launching abilities, in which pulley functions with flexible limbs to achieve a desired power. The short, powerful, flexible limbs are carried at opposite ends of a handle and the combination of pulleys connected with the limbs achieve desired power with minimal effort to draw and launch arrows.

A further object of this invention includes a coil spring that is mounted and is connected through a wheel and pulley system to a bow string; the action of drawing back the bow connected to the bow string causes the coil spring to wind up, flexing the limbs, creating stored energy. The pulley system provides a mechanical advantage over a basic sling-shot-type hunting weapon whereby only a small force is required to draw the bow and bow string backwards to create energy, and a higher recoil velocity is gained when the string is released without the use of a mechanical trigger release.

While the foregoing written description of the invention enables one of ordinary skill to make and use what is considered presently to be the best mode thereof, those of ordinary skill will understand and appreciate the existence of variations, combinations, and equivalents of the specific embodiments, methods, and examples herein. And, although the present invention has been discussed in considerable detail with reference to certain preferred embodiments, other embodiments are possible. Therefore, the scope of the appended claims should not be limited to the description of preferred embodiments, methods, and examples contained herein.

What is claimed is:

1. An archery bow comprising:

a block comprising;

a handle being adapted to be held by a user with his or her hand in a vertical grip position, and a center block having a bottom side, top side, a front side, and back side, the bottom side of the center block being affixed to the handle, the center block comprising a center bore and first and second end portions, wherein the center bore extends from the front side of the block to the back side of the block and is open to the top side of the block;

an arrow guide attached centrally to the center bore and positioned in front of the central bore on the center block, the arrow guide having a top side opening for positioning the forward end of an arrow through the center bore and through the arrow guide;

a first limb affixed to the first end portion of the center block, the first limb having a first limb end portion;

a second limb affixed to the second end portion of the center block, the second limb having a second limb end portion;

first and second pulleys rotatably combined with respective first and second limb end portions so as to rotate around a rotating axis of each pulley; and a bowstring formed between the first and second pulleys, the bowstring being configured to receive the notched end of an arrow, and being pulled for discharge of the arrow through the center bore of the block and the arrow guide, wherein the center block is affixed to the handle in a perpendicular configuration such that the handle is perpendicular to an elongated top section of the center block, the first and second limbs, and the bowstring.

2. The archery bow according to claim 1 further comprising an arm stabilizer affixed to the center block and extending rearwardly from the center block ck and extending rearwardly from the center block.

3. The archery bow according to claim 1, further comprising an attached quiver.

4. The archery bow according to claim 1, further comprising an attached sight.

5. The archery bow according to claim 1, further comprising a cable guide attached to the center block and extending rearwardly to engage the bowstring.

6. The archery bow according to claim 1, wherein the archery bow further comprises a stability stick.

7. An archery bow comprising:

a block comprising;

a handle being adapted to be held by a user with his or her hand in a vertical grip position, and a center block having a bottom side, top side, a front side, and back side, the bottom side of the center block being affixed to the handle, the center block comprising a center bore and first and second end portions, wherein the center bore extends from the front side of the block to the back side of the block and is open to the top side of the block;

an arrow guide attached centrally to the center bore and positioned in front of the center bore on the center block, the arrow guide having a top side opening for positioning the forward end of an arrow through the center bore and through the arrow guide;

a first limb affixed to the first end portion of the center block, the first limb having a first limb end portion;

a second limb affixed to the second end portion of the center block, the second limb having a second limb end portion;

first and second pulleys rotatably combined with respective first and second limb end portions so as to rotate around a rotating axis of each pulley; and a bowstring formed between the first and second pulleys, the bowstring being configured to receive the notched end of an arrow, and being pulled for discharge of the arrow through the center bore of the block and the arrow guide, an arm stabilizer affixed to the block and extending rearwardly from the block, the arm stabilizer comprising a first and second brace bars and a pliable strap connecting the first and second brace bars, wherein the center block is affixed to the handle in a perpendicular configuration such that the handle is perpendicular to an elongated top section of the center block, the first and second limbs, and the bowstring.

8. The arm stabilizer according to claim 7, wherein the arm stabilizer is removably affixed to the center block.

9. The arm stabilizer according to claim 7, wherein the arm stabilizer is affixed to the handle.

* * * * *